US005088402A

United States Patent [19]

Hycner et al.

[11] Patent Number: 5,088,402

[45] Date of Patent: Feb. 18, 1992

[54] PRESSURIZED PRINTING FLUID INPUT SYSTEM FOR KEYLESS LITHOGRAPHIC PRINTING

[75] Inventors: Stanley H. Hycner, Batavia; Garry F. Tupek, Naperville; Walter J. Pelczarski, Downers Grove, all of Ill.

[73] Assignee: Rockwell International Corporation, El Segundo, Calif.

[21] Appl. No.: 534,404

[22] Filed: Jun. 7, 1990

[51] Int. Cl.[5] ..... B41F 31/06; B41F 31/08; B41L 27/08

[52] U.S. Cl. ..... 101/142; 101/350; 101/366

[58] Field of Search ..... 101/366, 363, 350, 148, 101/349, 364, 207, 208, 209, 210, 169, 157, 142; 118/410, 413

[56] References Cited

U.S. PATENT DOCUMENTS

| | | | |
|---|---|---|---|
| 2,154,544 | 4/1939 | Taylor | 101/350 |
| 2,177,656 | 10/1939 | Kaddeland | 101/366 |
| 3,045,592 | 7/1962 | Shearer et al. | 101/364 X |
| 4,064,801 | 12/1977 | Switall | 101/366 |
| 4,085,672 | 4/1978 | Grosart | 101/169 |
| 4,461,211 | 7/1984 | Wesselmann | 101/169 |
| 4,590,855 | 5/1986 | Schommer et al. | 101/350 |
| 4,625,643 | 12/1986 | Davis | 101/363 |
| 4,688,516 | 8/1987 | Sommer | 118/410 |

*Primary Examiner*—J. Reed Fisher

*Attorney, Agent, or Firm*—C. B. Patti; V. L. Sewell; H. F. Hamman

[57] ABSTRACT

A printing fluid input system (30) for use in a keyless lithographic printing press wherein a metering roller (20) has at least first and second ends mounted for rotation about an axis and has an oleophilic and hydrophobic surface (40) intermediate the first and second ends (32,34) which retains a natural quantity of printing fluid. A housing (42) has an open first side (46) which mates with at least a portion of the surface (40) of the metering roller (20) to define a closed chamber (44) containing the printing fluid under a predetermined pressure. End seal assemblies (48, 50) are mounted on opposed ends of the housing (42), each of the end seal assemblies (48,50) having at least a first surface (56) for mating with respective end sections (58,60) of the metering roller (20). A reverse angle doctor blade (62) on the housing (42) has an edge (66) for contacting the surface (40) of the metering roller (20) for removing excess printing fluid adhering to the surface (40) as the metering roller (20) rotates. A sealing member (68) on the housing (42), has a surface area (72) for substantially sealing the chamber (44), the surface area (72) of the sealing member (68) being substantially adjacent the surface (40) of the metering roller (20). The metering roller (20), the end seal assemblies (48,50) the reverse angle doctor blade (62) and the sealing member (68) seal the chamber (44) such that the printing fluid is under the predetermined pressure. The housing (42) can be located anywhere about the circumference of the metering roller (20).

39 Claims, 9 Drawing Sheets

PRESSURIZED PRINTING FLUID INPUT SYSTEM FOR KEYLESS LITHOGRAPHIC PRINTING

BACKGROUND OF THE INVENTION

The present invention relates to printing fluid input systems for use in keyless lithographic printing processes.

In the field of high speed lithographic printing, ink is continuously conveyed from an ink source by means of a series of rollers to a planographic printing plate on a plate cylinder in a lithographic printing press. Image portions of the printing plate accept ink from one or more of the last of a series of inking rollers and transfer a portion of that ink to a blanket cylinder as a reverse image from which a portion of the ink is transferred to form a correct-reading image on paper or other materials. It is also essential in conventional lithographic printing processes that a dampening solution containing water and proprietary additives be conveyed continuously to the printing plate whereby transferring in part to the non-image areas of the printing plate the water functions to keep those non-image areas free of ink. Hereinafter, the terms "water" and "dampening solution" refer to water plus additives or to other aqueous solutions used in the operation of lithographic printing presses.

In conventional printing press systems, the ink is continuously made available in varying amounts determined by cross-press column input control adjustments to all parts of the printing plate, including both image and non-image areas. In the absence of the dampening solution, the printing plate will accept ink in both the image and non-image areas of its surface.

Lithographic printing plate surfaces in the absence of imaging materials have minute interstices and a hydrophilic or water-loving property to enhance retention of water, that is the dampening solution, rather than ink on the surface of the plate. Imaging the plate creates oleophilic or ink-loving areas according to the image that is to be printed. Consequently, when both ink and dampening solution are presented to an imaged plate in appropriate amounts, only the ink tending to reside in non-image areas becomes disbonded from the plate. In general, this action accounts for the continuous ink and dampening solution differentiation on the printing plate surface, which is essential and integral to the lithographic printing process.

Controlling the correct amount of dampening solution supplied during lithographic printing has been an industry-wide problem ever since the advent of lithography. It requires continual operator attention since each column adjustment of ink input may require a change in dampener input. Balancing the ink input that varies for each column across the width of the press with a uniform dampening solution input across the width of the press is at best a compromise. Consequently, depending upon which portion of the image the operator has adopted as his standard of print quality at any given time during the printing run, the operator may need to adjust the ink input at correspondingly-located cross-press positions. As a result, the dampening solution to ink ratio at that position may become changed from a desired value. Conversely, the operator may adjust a dampener input for best ink and dampening solution balance at one inking column, which may adversely affect the ink and dampening solution balance at one or more other cross-press locations. Adjustments such as these tend to occur repeatedly throughout the whole press run, resulting in slight to significant differences in the quality of the printed image throughout the run. In carrying out these adjustment operations, the resulting images may or may not be commercially acceptable, leading to waste in manpower, materials, and printing machine time.

Certain commercially successful newspaper printing configurations rely on the inking train rollers to carry dampening solution directly to the printing plate. Notable among these are the Goss Metro, Goss Metroliner, and the Goss Headliner Offset printing presses which are manufactured by the Graphic Systems Division of Rockwell International Corporation. In these alternative configurations, the dampening solution is combined with the ink on an inking oscillator drum such that both ink and water are subsequently and continuously transferred to the inking form rollers for deposition onto the printing plate. In another variation, the dampening solution is applied in a conventional manner directly to the printing plate by means of separate dampening rollers and a dampening solution supply system. In systems of either type, regardless of the method whereby the dampening solution is introduced, it is well known that some of the dampening solution becomes mixed with the ink and returns to the inking train of rollers and may ultimately be introduced into the ink supply system itself. In any case, these conventional lithographic systems require considerable operator attention to maintain ink and dampening solution balance and produce more product waste than desired.

Prior art devices and methods for correcting this inherent fault in conventional lithography utilize keyless inkers. Certain of these methods also involve eliminating the dampening system or eliminating operator control of the dampening system.

Keyless inking systems have been disclosed that purport to eliminate operator attention to column control of inking by elimination of adjustable inking keys, thereby avoiding much of the aforementioned disadvantages of conventional lithography. For keyless inking systems an ink metering method is required that continues to function despite the presence of up to about 40% dampening solution in the ink without allowing any temporarily-free dampening solution to interfere with the ink-metering function. Also, the unused or non-uniform portion of the ink film that is being continuously presented to the printing plate must be continuously scraped-off the return side of the inking system to enable continuous presentation of the uniform ink film to the plate by the supply side of the inking system. This scraped-off film is not uniform across the width of the press in ink and dampening solution composition. Since it would not be economically feasible to continuously discard the ink in the unused portion of the ink and dampening solution mixture, this mixture must either be renewed by selectively removing dampening solution from the mixture and returning the ink portion to the inking system or by thoroughly intermixing the unused ink and dampening solution mixture with fresh replenishment ink and returning such mixture to the inking system. U.S. Pat. No. 4,690,055 discloses a keyless inking system in which dampening solution removal is unnecessary and which accommodates the dampening solution that is naturally acquired in the unused ink during the practice of lithography and for which, therefore, removal of dampening solution is not required.

In the keyless inking system disclosed in U.S. Pat. No. 4,690,055 (hereby incorporated by reference), the location of the dampening system is not critical and can be positioned either to supply dampening solution directly to the plate cylinder or at some other location such as at an oscillator drum to which ink is also being supplied. An ink circulating and mixing system receives new or replenishment ink, as well as, the ink and dampening solution combination, that is continuously returned from a doctor blade which scrapes excess printing fluid from a rotating metering roller. Such ink and dampening combinations are generally herein referred to as printing fluids. The printing fluid circulating and mixing system functions to assure an inherently uniform cross-press input of printing fluid that remains consistent throughout and consists of a printing fluid pan roller, pump and appropriate conduits, a printing fluid pan level controlling system, and a printing fluid reservoir of such volume and design that it assures the printing fluid being fed to the metering roller is uniform in composition at any given instant of time despite the existence of the continual cross-press dampening solution to ink ratio differences of the unused or scraped return printing fluid previously referred to. The printing fluid circulation system is designed to continuously collect and distribute the printing fluid from a reservoir through a plenum or series of orifices to uniformly redistribute the printing fluid across the press width to provide uniform composition of the printing fluid that is being introduced to the metering roller. The metering roller can be one of the types shown and described in U.S. Pat. Nos. 4,882,990, 4,537,127, 4,862,799, 4,567,827, or 4,601,242, (all of which are hereby incorporated by reference) or any wear resistant oleophilic and hydrophobic metering roller as substantially therein defined.

Although the system disclosed in U.S. Pat. No. 4,690,055 provides great improvements in lithographic printing presses, the technology requires a rather large and cumbersome ink pan arrangement that is more-or-less open to the press room environment. It requires that the pan be disposed beneath the metering roller/doctor blade confluence so that scraped off excess and return printing fluid film will fall readily into the pan arrangement. Pan roller or metering roller replacement is inconvenient and time consuming because of the large pan size and its peripheral attachments. Additionally, the pan roller requires a separate motor to drive it nominally at a speed slower than the press speed metering roller. Due to the more-or-less open nature of the pan system, the pan roller which dips into the pool of printing fluid cannot be driven at press speeds because printing fluid would be propelled from its surface in many directions, including outside of the pan regions into the pressroom. Also, the slow rotational movement of the pan roller causes undue and severe wear on the metering roller surface when the two are in indented relationship. Consequently, the pan roller/metering roller confluence must be a gap. Control of that gap to avoid metering roller wear and yet simultaneously assure complete filling of the metering roller cells is difficult to engineer and to control over long periods of running time.

The present invention overcomes the aforementioned problems, difficulties and inconveniences, yet retains all of the principles essential to keyless lithographic systems as disclosed in U.S. Pat. No. 4,690,055. Accordingly, in this improvement the pan and pan roller are replaced by a completely enclosed, smaller and simplified printing fluid input apparatus and circulation system.

SUMMARY OF THE INVENTION

An object of the present invention is to provide an improved keyless lithographic printing system having more simplified printing fluid input means than are required in prior art keyless lithographic printing systems.

It is another object of the present invention to provide a closed pressurized printing fluid input system for conveying printing fluid to the lithographic printing press.

It is a further object of the present invention to provide a printing fluid circulating system that functions to assure that the aqueous dampening solution that naturally appears in the ink is maintained in a thoroughly homogenized condition thereby negating buildup of free dampening solution anywhere in the inking system which would result in debonding of the ink from the metering roller and inking rollers.

It is another object of the present invention to provide a printing fluid input apparatus which can be positioned anywhere on the circumference of the metering roller.

It is yet a further object of the present invention to provide a controlled flow of substantially uniform printing fluid through the printing fluid input apparatus.

It is yet another object of the present invention to provide a printing fluid circulating system having a printing fluid reservoir whose location is independent of the location of the printing fluid input apparatus.

The objects are achieved by an improved printing fluid input system for use in a keyless lithographic printing press of the type having blanket cylinder, plate cylinder with printing plate mounted thereon, form cylinders, optionally an inking train of two or more inking rollers, and a system for supplying dampening solution to the printing plate. A metering roller in the press has at least first and second ends mounted for rotation about an axis and has an oleophilic and hydrophobic surface intermediate the first and second ends which surface has a capability of retaining a defined quantity of printing fluid. A housing has an open first side which mates with at least a portion of the surface of the metering roller to define a closed chamber containing the printing fluid under a predetermined pressure. First and second end seal assemblies are mounted on first and second opposed ends of the housing, each of the first and second end seal assemblies having at least a first surface for mating with first and second end sections, respectively, of the metering roller. A reverse angle doctor blade is attached to a second side of the housing and has an edge for contacting the surface of the metering roller for removing excess printing fluid adhering to the surface of the metering roller as the metering roller rotates. A sealing member is attached to a third side of the housing, the third side of the housing being opposed from the second side of the housing, and has a surface area for substantially sealing the chamber, the surface area of the sealing member being at least adjacent the surface of the metering roller. The metering roller, the first and second end seal assemblies, the reverse angle doctor blade and the sealing member form a sealed chamber such that the printing fluid is under the predetermined pressure. The housing has at least one inlet for inputting the printing fluid into the chamber, and at least one outlet for outputting the printing fluid from the chamber, the inlet and outlet being connected to a circulating printing fluid system which pressurizes the chamber and which controls the flow of printing fluid through the chamber.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
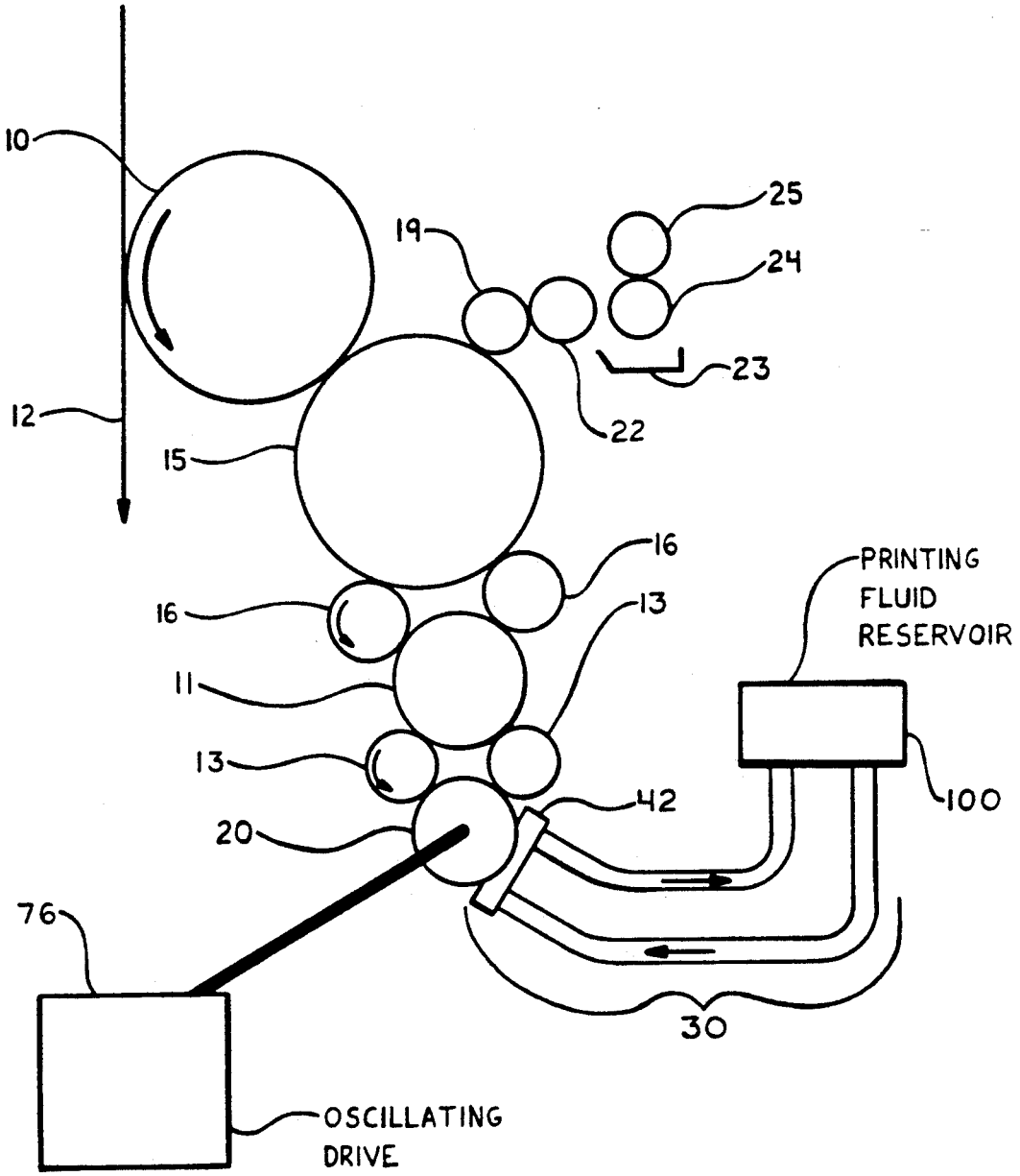
FIG. 1 is a schematic side view of a keyless lithographic printing press system in accordance with the present invention.

A keyless inking system incorporating the present invention is depicted in FIG. in which a blanket cylinder 10 prints on a web traveling as indicated by the directional arrow 12. Referring first to the dampening and inking systems associated with blanket cylinder 10, a plate cylinder 15 is contacted by two ink form rollers 16 which are in turn contacted by a metering roller 20 via copper drum 11 and two transfer rollers 13. The ink metering roller 20 is preferably of the type disclosed in U.S. Pat. Nos. 4,862,799, 4,882,990, 4,537,127, 4,567,827 or 4,601,242 which were cited previously. In the dampening arrangement associated with plate cylinder 15 there typically is provided a rubber dampener form roller 19 and, for instance, a copper covered or a chrome covered oscillating transfer roller 22. The water is contained in a pan tray 23 and a pan roller 24 is used to pick up water from the pan 23 to bring it into contact with a spiral brush roller 25 that is rotating in a direction opposite to the direction of rotation of pan roller 24. It should be recognized that virtually any known dampening system can be used with the present invention.

With this or other arrangements dampening solution is transferred onto the transfer roller 22 and from there to the dampener form roller 19. The form roller 19 is typically positioned in a water-first sequence so that, during each revolution of the press subsequent to transferring ink to the blanket cylinder 10, plates are first subjected to dampening solution from the dampener form roller 19 before renewed printing fluid is applied to the imaged surface of the plates by means of the rubber covered ink form rollers 16.

The most significant part of the present invention is the inking system that is used to supply printing fluid to the plate and blanket cylinders 15, 10. This system, makes it possible to supply a uniform mixture of ink and naturally occurring dampening solution to the plate cylinder 15 and thereby maintain the high print quality characteristic of conventional lithography. In this arrangement the printing fluid input system is identified generally by the numeral 30 and is used to deliver ink containing dampening solution, also referred to as the printing fluid, to the metering roller 20. Dampening solution in this system is not deliberately added to the ink but rather results naturally from ink coming in contact with dampening solution on the printing plate cylinder 15 and which, by means of the unused or return portion of printing fluid that passes or transfers back down through the various rollers, in part eventually enters the printing fluid input system 30.

Figure 2:
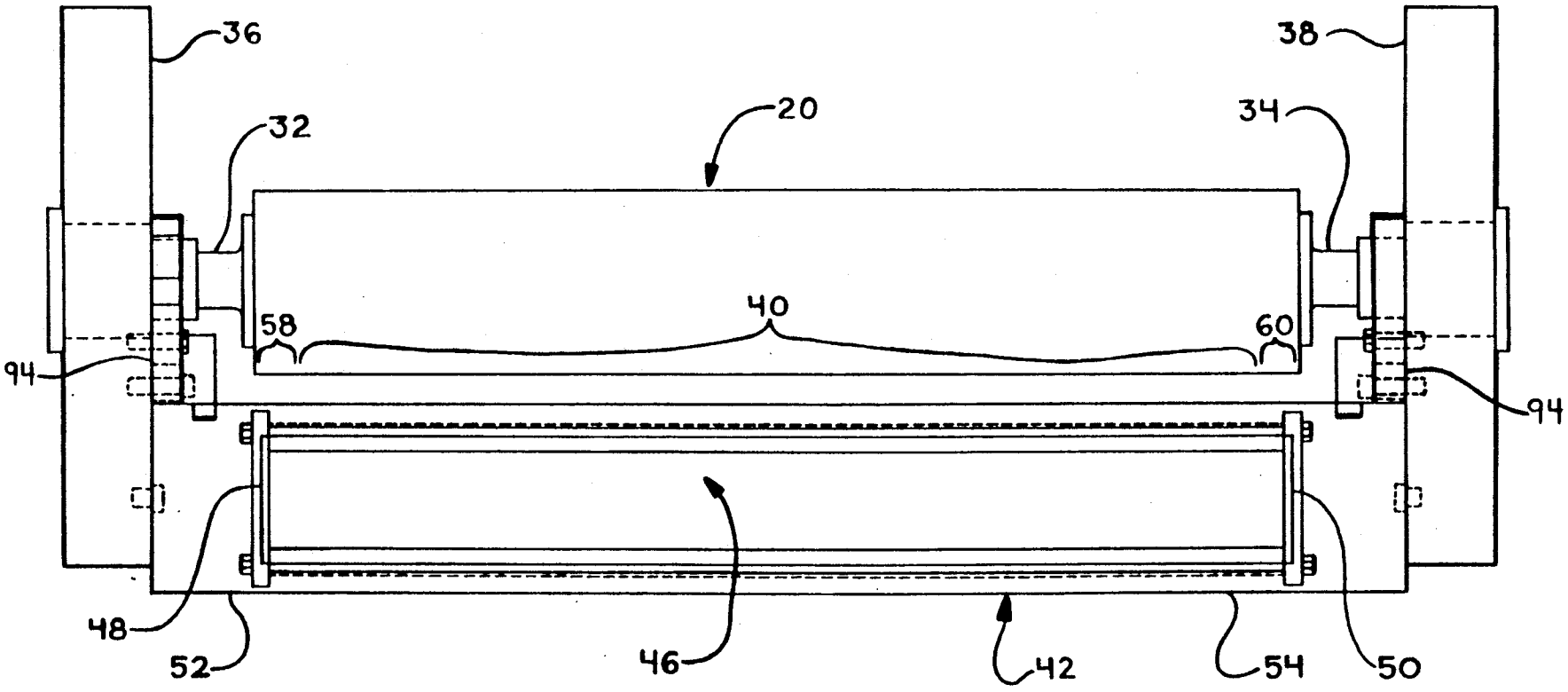
FIGS. 2 and 3 are plan and elevation views, respectively, of the printing fluid input apparatus of the present invention and of a metering roller.
Figure 3:
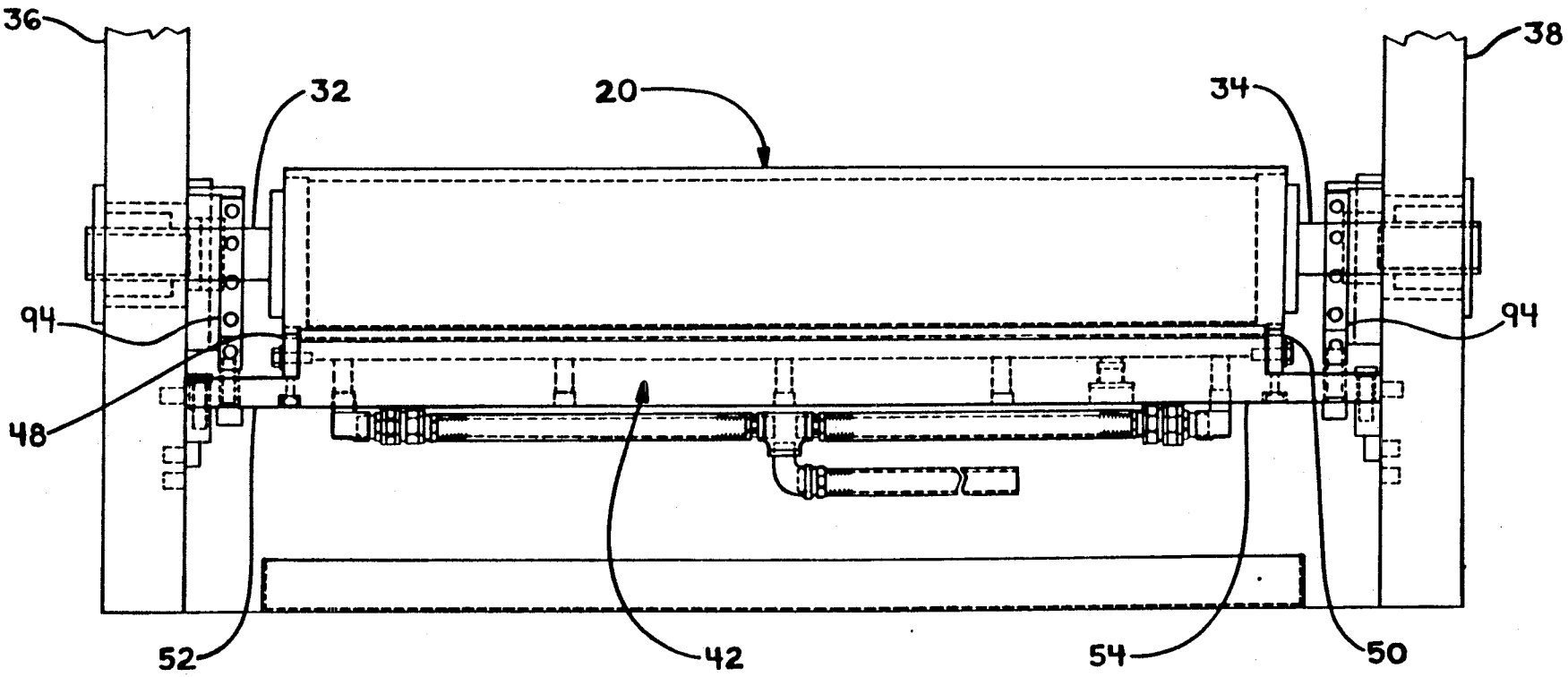
Figure 4:
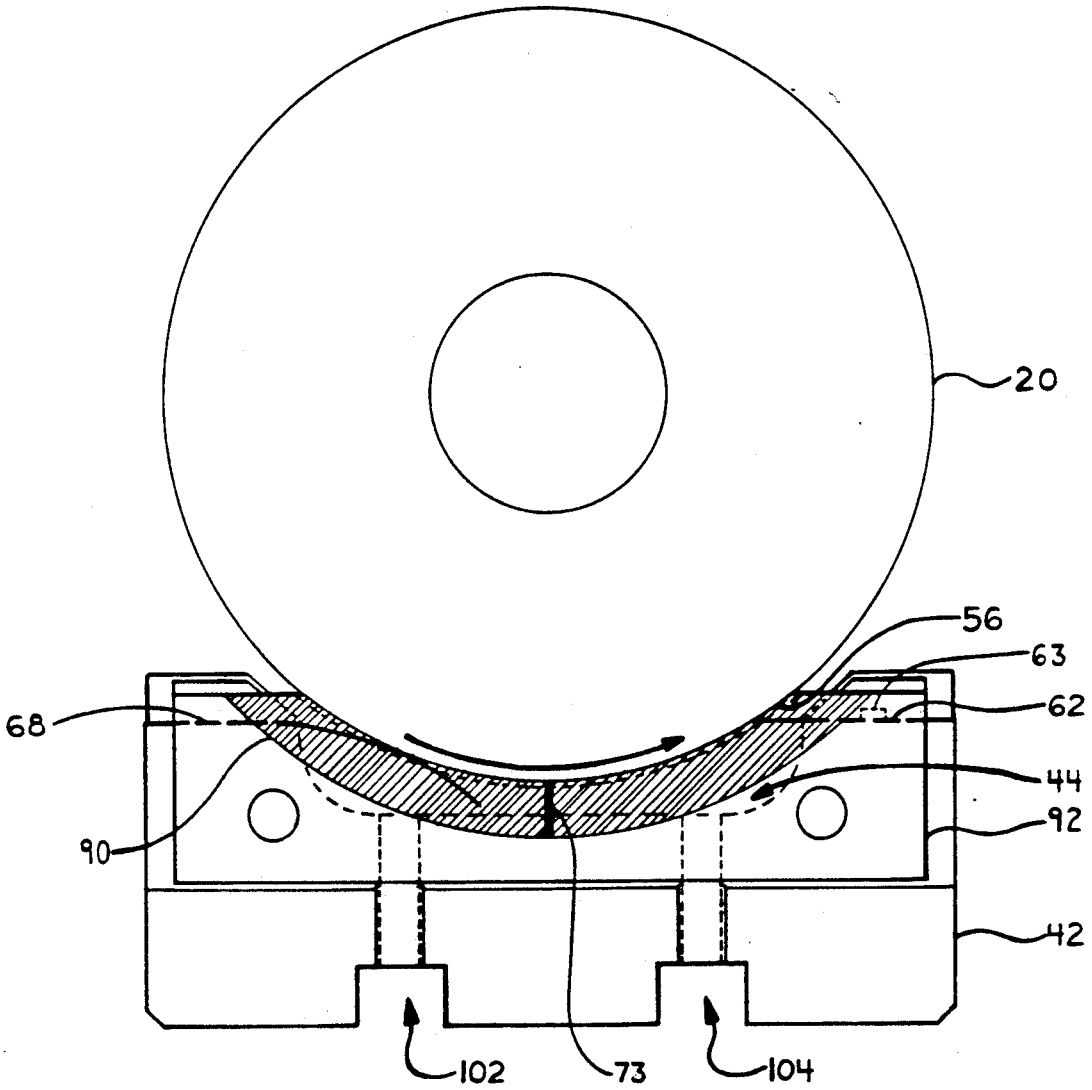
FIG. 4 is an end view of the printing fluid input apparatus and the metering roller.

The printing fluid input apparatus of the system 30 of the present invention is depicted in an open servicing position relative to the metering roller 20 in FIGS. 2 and 3. An end view of the apparatus engaged with the metering roller 20 in a closed operating position is depicted in FIG. 4. The metering roller 20 has first and second ends 32 and 34 which rotate in frames 36 and 38, respectively. The metering roller 20 has a surface 40 intermediate the first and second ends 32 and 34, the surface 40 capable of retaining a quantity of printing fluid. A housing 42 has an open first side 46 which mates with at least a portion of the surface 40 of the metering roller 20. When the housing 42 is in the closed operating position a chamber 44 is formed which contains the printing fluid under a predetermined pressure.

At least first and second end seal assemblies 48 and 50 are mounted on first and second opposed ends 52 and 54, respectively, of the housing 42. Each of the first and second end seal assemblies 48 and 50 have at least a first surface 56 for mating with first and second end sections 58 and 60, respectively, of the metering roller 20.

Figure 5:
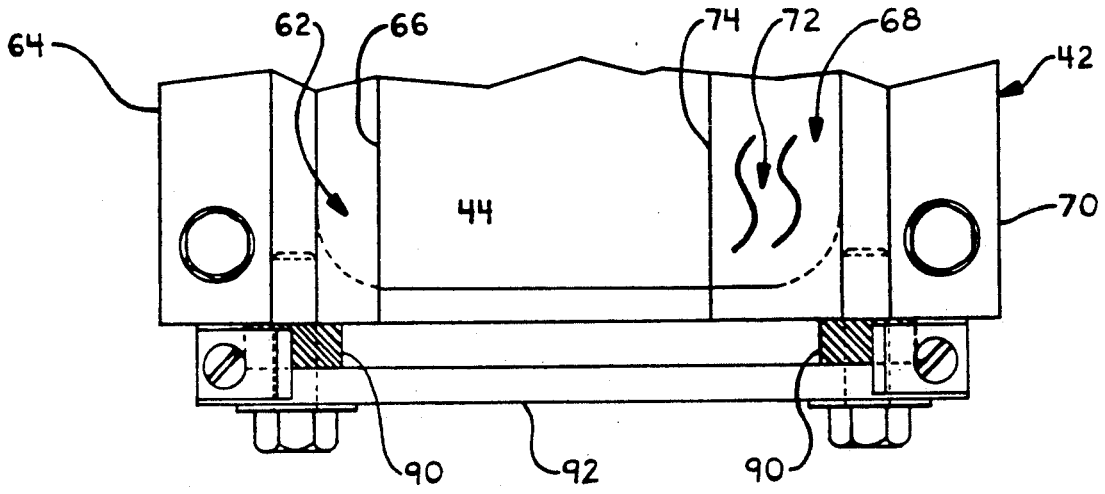
FIG. 5 is a partial plan view of the printing fluid input apparatus.

Referring now also to FIGS. 4 and 5 a reverse angle doctor blade 62 is attached to a second side 64 of the housing 42 and has an edge 66 for contacting the surface 40 of the metering roller 20 and for removing excess printing fluid adhering to the surface 40 as the metering roller 20 rotates past the printing fluid filled chamber 44. A sealing member 68 is attached to a third side 70 of the housing 42 and has a surface area 72 for substantially sealing the chamber 44, at least the surface area 72 of the sealing member 68 being adjacent the surface 40 of the metering roller 20 such that an edge 74 of the sealing member 68 extends into the chamber 44. In a preferred embodiment the sealing member 68 is substantially longer and more flexible than the reverse angle doctor blade 62.

Since the printing fluid in the chamber 44 is under pressure it is a feature of the present invention that the reverse angle doctor blade 62 is held against the surface 40 of the metering roller 20 at least in part by this pressurized printing fluid in the chamber 44.

It is well known in the art of printing presses to provide devices which cause selected rollers or cylinders to oscillate (for example the roller oscillation drive disclosed in Goss Metroliner Parts Catalog No. 280-PC, FIG. 280-56). In the present invention such a means for oscillating 76 can be attached to the metering roller 20, thus providing oscillation to the metering roller 20, while the housing 42 of the printing fluid input apparatus 30 remains stationary. The metering roller 20 is of the type having an oleophilic and hydrophobic surface.

Depending upon the application it may or may not be necessary to provide oscillation to the metering roller 20. However, it is a novel feature of the present invention that in those applications where it is desirable to provide oscillation to the metering roller 20 it is feasible to accomplish this with the printing fluid input apparatus of the present invention.

The sealing member 68 may, for instance, be formed of steel or plastic and have a width in the range of approximately 1 to 2 inches and a thickness in the range of approximately 0.004 to 0.01 inch selected as a function of the open first side dimension of the housing 42 and of the diameter of the metering roller 20 which mates with the open first side, such that the sealing member 68 properly seals the chamber 44. The reverse angle doctor blade 62 may be formed of steel or plastic and in general have a width of approximately 1 inch and a thickness in the range of approximately 0.004 to 0.01 inch, if steel, and 0.04 to 0.06 inch, if plastic.

Figure 6:
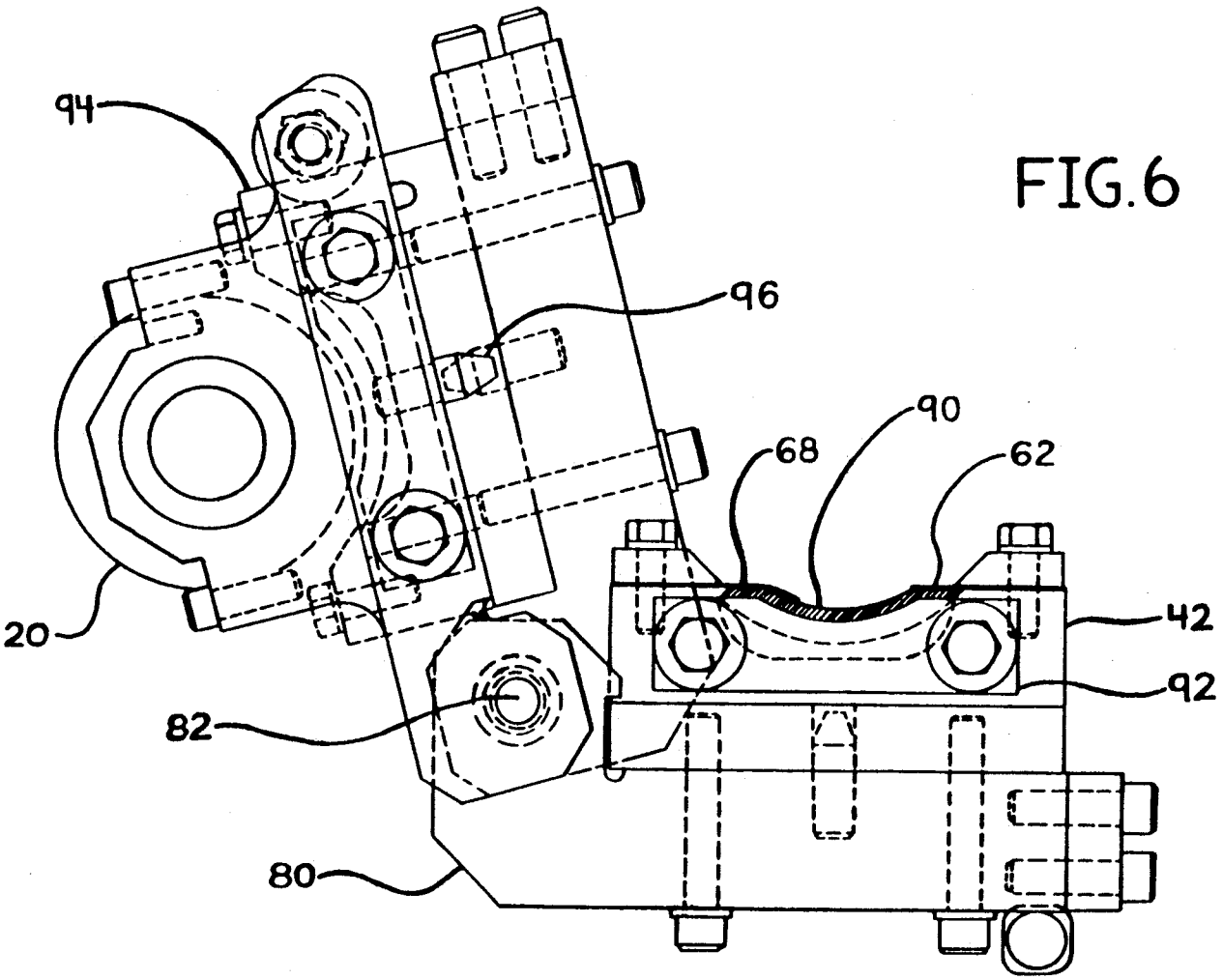
FIG. 6 is an end view of the metering roller and the printing fluid input apparatus in an open servicing position.

As shown in FIG. 6 the housing 42 is attached to a support 80 which is pivotable about axis 82 and thus provides an open servicing position and a closed operating position. The housing 42, as well as metering roller 20, are shown in the open servicing position in FIGS. 2 and 3, FIG. 2 being a plan view and FIG. 3 being an elevation view.

The printing fluid input apparatus further includes at least one inlet means 102 in the housing 42 for inputting printing fluid into the chamber 44 and at least one outlet means 104 in the housing 42 for outputting printing fluid from the chamber 44. Since the chamber 44 is sealed by the metering roller 20, the first and second end assemblies 48 and 50, the reverse angle doctor blade 62 and the sealing member 68, it is thus possible to keep the printing fluid under a predetermined pressure. In the preferred embodiment, as will be discussed below, a circulating system is used to pump the printing fluid through the housing 42. It is an important feature of the present invention that, since the printing fluid is under pressure, the printing fluid circulation system is totally independent of the force of gravity as opposed to prior art systems that rely on the printing fluid falling into a reservoir or catch pan. Therefore, the housing 42 can be located anywhere around the circumference the metering roller 20. This has significant and important advantages in the art of keyless lithographic printing press design. It allows for printing couples of a press to be inverted thereby shorting the length of the paper path between the couples, as well as, providing savings in space and materials of construction. This freedom to locate the housing 42 anywhere around the circumference of the metering roller 20 provides a degree of freedom in design of the printing press not found in prior art keyless printing presses.

Furthermore, the housing 42 can be designed to extend the full axial length of the surface 40 of the metering roller 20 or to extend only over a portion of the surface 40. For example, a number of housings, each less than full press width, can be located on one metering roller. Also, the housing 42 can be structured to wrap around the circumference of the metering roller 20 to greater or lesser extents depending upon the criteria of the press being design.

Figure 11:
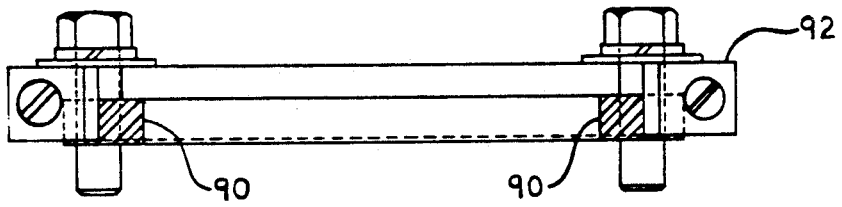
FIGS. 10 and 11 are a plan view and an elevation view of a seal cap assembly used in the present invention.
Figure 10:
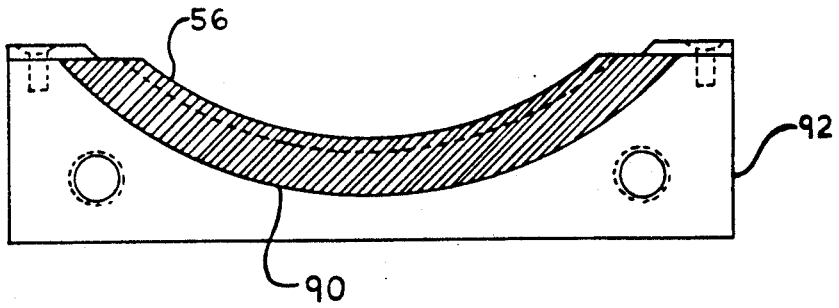

Referring now to FIGS. 10 and 11, each of the end seal assemblies 48 and 50 shown in FIGS. 2 and 3 has a seal 90 which is supported by a seal cap 92. As can be seen in FIG. 5 the seal cap 92 is attached to an end of the housing 42, more specifically a seal cap assembly is attached to each end of the housing 42.

Figure 9:
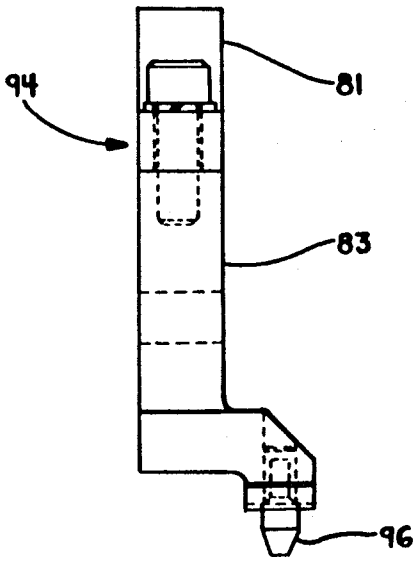
FIGS. 7, 8 and 9 are a plan view, an elevation view and a side view of a gage assembly used in the present invention.
Figure 8:
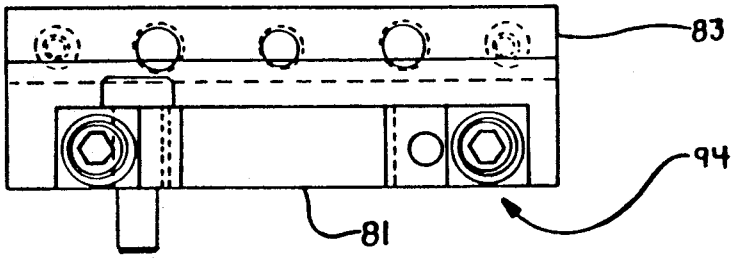
Figure 7:
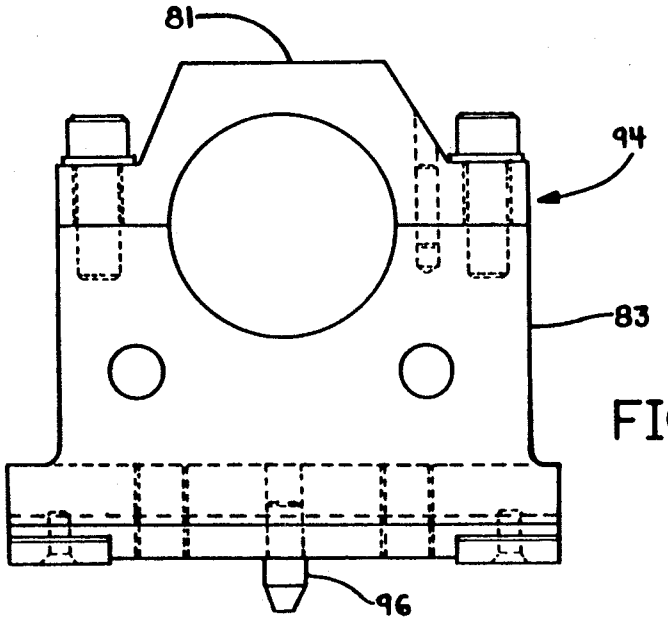

Furthermore, the present invention can include a gage assembly 94, as shown in FIGS. 7, 8 and 9, which engages the housing 42 with a locating pin 96 when the housing 42 is pivoted into the closed operating position for accurate positioning of the housing 42 relative to the metering roller 20, see FIG. 6. The gage assemblies 94 are located adjacent the first and second end sections 32 and 34 of the metering roller 20. The gage assembly 94 has first and second sections 81, 83 which surround the ends 32, 34 of the metering roller 20.

In general a means 100 for pressurizing with the printing fluid the chamber 44 in the housing 42 is connected to the housing 42 via the inlet means 102 and the outlet means 104 on the housing 42.

Figure 12:
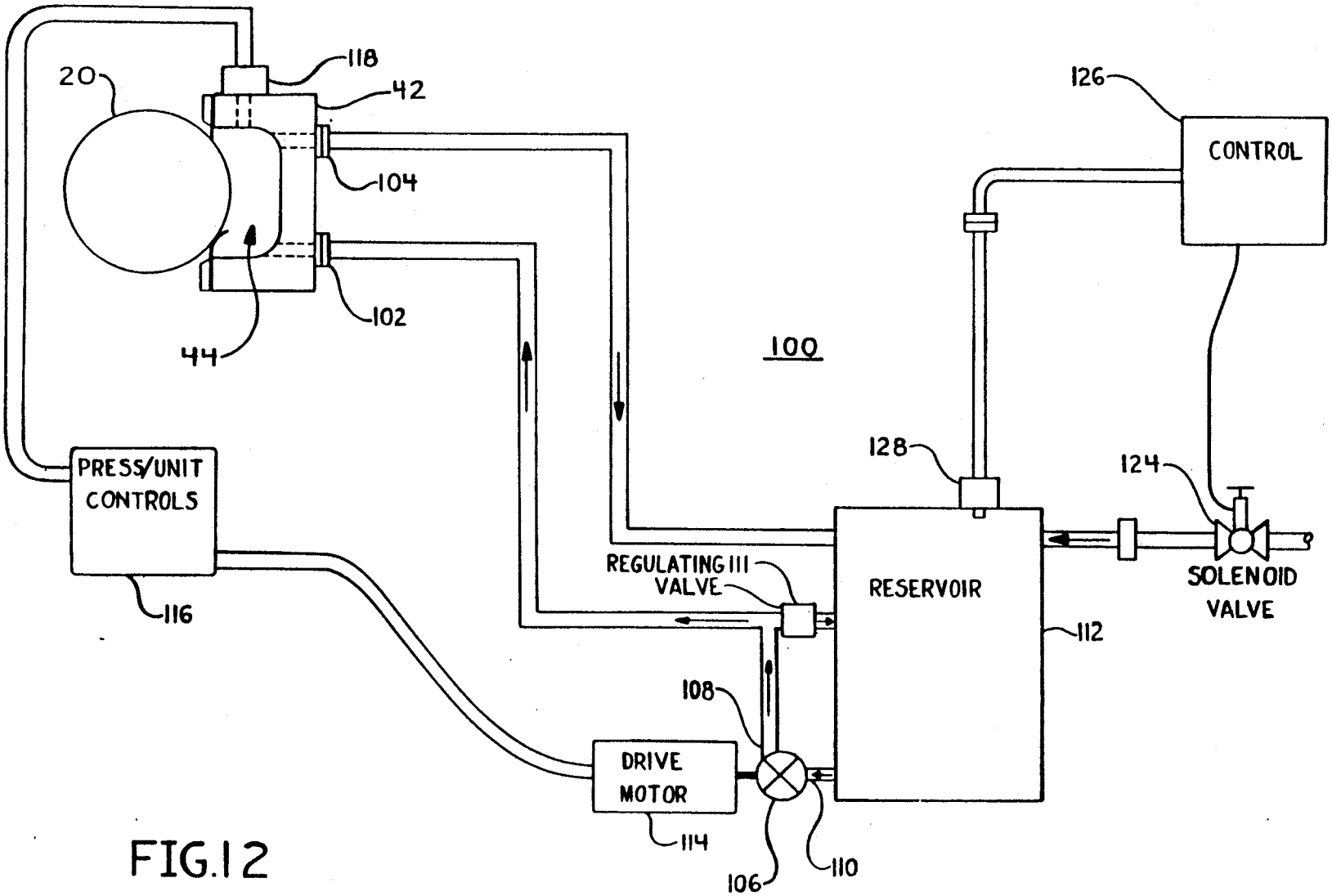
FIGS. 12 and 13 are schematic representations of pressurized printing fluid circulation systems used with the present invention.

As shown in FIG. 12, the means 100 for pressurizing is a circulating system having a pump 106 with an output 108 and an input 110. The output 108 of the pump 106 is connected to a pressure regulating check valve 111 and to the inlet means 102 of the housing 42. The input 110 of the pump 106 is connected to an printing fluid reservoir 112 which is also connected to the outlet means 104 of the housing 42. As shown in FIG. 12 the pressure regulating check valve 111 is also connected to the printing fluid reservoir 112. In the preferred embodiment the pump 106 is driven by a constant speed drive motor 114 which is connected to press/unit controls 116 of the printing press. The press/unit controls 116 may also receive signals from a sensor 118 mounted in the housing 42 for sensing the pressure of the printing fluid in the chamber 44 of the housing 42. In one embodiment a pressure of 4–6 psi is maintained in the chamber 44 to enable smooth consistent printing fluid input to metering roller 20. The pressure regulating check valve 111 functions to set the pressure of 4–6 psi in the chamber 44 and allows a portion of the printing fluid to flow back into the printing fluid reservoir 112, as necessary.

Figure 13:
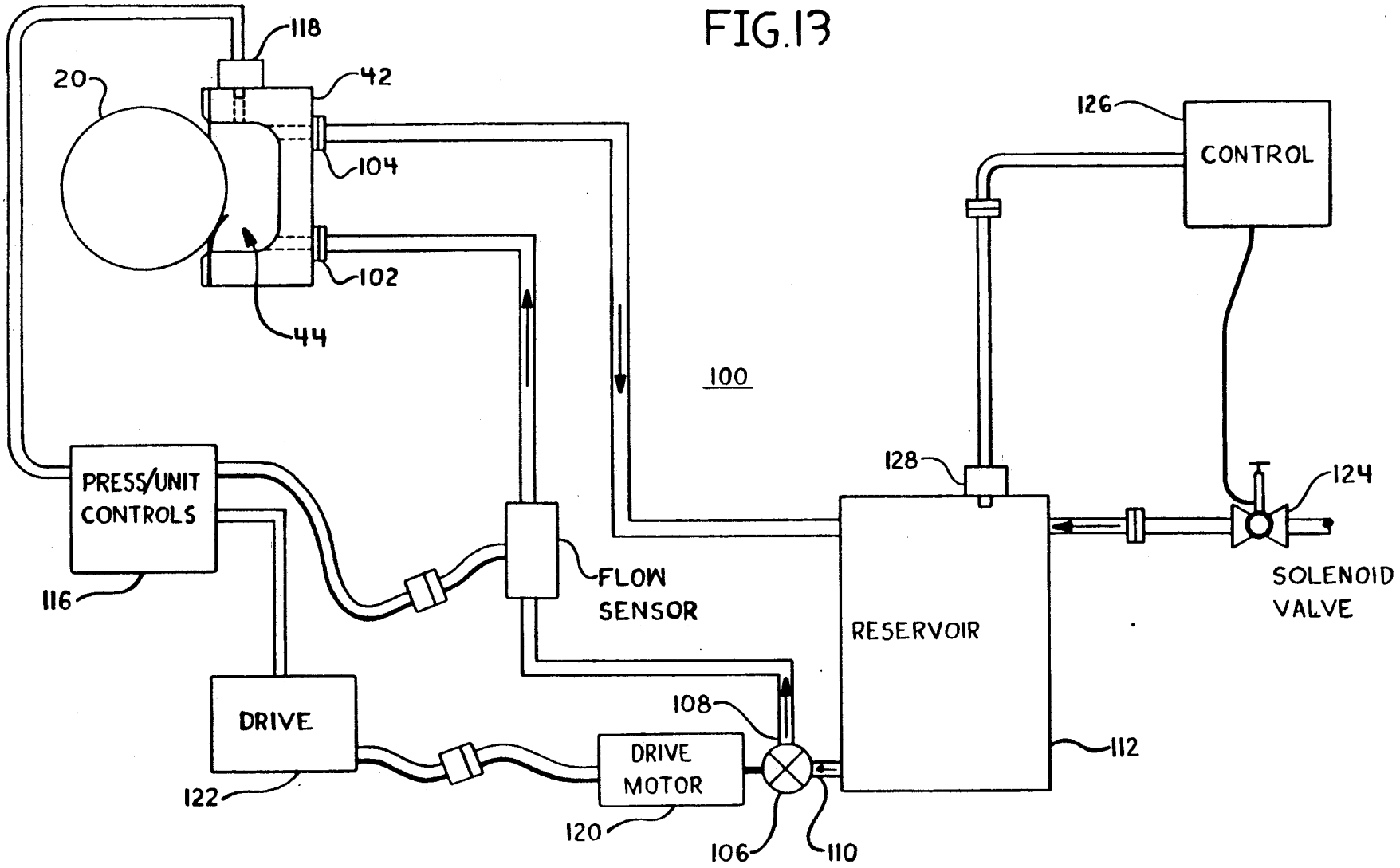

FIG. 13 depicts an alternative means 100 for pressurizing the chamber 44 wherein the pump 106 is driven by a motor 120 which is operated at a speed proportional to the speed of the printing press via variable speed drive 122. In this embodiment the output 108 of the pump 106 is connected to the inlet means 102 of the housing 42 and the outlet means 104 of the housing 42 is connected to the printing fluid reservoir 112. The input 106 of the pump is also connected to the printing fluid reservoir 112. Various means can be used to add fresh replacement ink to the printing fluid reservoir 112 in either the FIG. 12 or FIG. 13 embodiments as needed. For example, the means can include solenoid valve 124 which is connected to a press/unit controller 126, the press/unit controller 126 receiving a signal from a printing fluid level sensor 128 connected to the printing fluid reservoir 112. It is a novel feature of the present invention that the printing fluid reservoir 112 can be located at any position relative to the chamber 44, higher or lower than the chamber 44, since the printing fluid flow is regulated by internal pressure rather than by the force of gravity.

In addition the present invention can include a means 130 for controlling the temperature of the printing fluid in the chamber 44 of the housing 42. For example, as shown in FIG. 13, the means 130 for controlling the temperature can be connected directly to the housing 42 or as shown in FIG. 12 the means 130 for controlling the temperature can be connected to the printing fluid reservoir 112. The means for controlling the temperature can utilize resistance element strip heaters affixed to the housing 42 (for example, a Chromalox No. SL0515 flexible resistive element heater). For the printing fluid reservoir 112 an immersion heater such as Chromalox No. ARMTO-2155T2 can be used.

The present invention overcomes a number of problems, difficulties and restrictions in prior art keyless lithographic printing systems. For instance, the pan and pan roller of the cited prior art (U. S. Pat. No. 4,690,055) are replaced by a smaller and less complicated housing that together with the metering roller surface form a completely enclosed housing.

The inks selected for use in the present invention preferably have low values of viscosity at low rates of shear so that the printing fluid flows readily as compared to conventional lithographic inks. An ink having this property readily flows into and, subsequent to doctor blade metering as herein practiced, out of the cells or interslices in the surface of the rapidly rotating metering roller 20 as it moves past the pressurized slowly circulating printing fluid in chamber 44.

An important feature when using a low viscosity printing fluid with the present invention is that the ink can be formulated to have good printing fluid transfer properties in the inking train of rollers and yet have any of a wide range of viscosity values at low shear rates. This capability is not possible with prior art pan roller printing fluid input systems as the amount of fluid input to the metering roller is dependent upon the pan roller force and not on the printing fluid's mobility. This capability is also not possible without the use of oleophilic and hydrophobic metering rollers since water is more readily forced out of low viscosity printing fluids and in the absence of the hydrophobic property will debond the fluid from the metering roller, thereby negating control of ink input.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. In a keyless lithographic printing press having blanket cylinder, plate cylinder with printing plate mounted thereon, form rollers, a set of two or more inking rollers, metering roller having at least an oleophilic and hydrophobic surface which retains a quantity of printing fluid, and a system for supplying dampening water to the printing plate, an improved printing fluid input apparatus comprising:

means for housing having an open side which mates with at least a portion of said surface of said metering roller to define a closed chamber substantially filled with said printing fluid under a predetermined pressure;

at least first and second means for end sealing mounted on opposed ends of said means for housing, each of said first and second means for end sealing slidably engaging said metering roller;

means for substantially removing excess printing fluid adhering to said surface of said metering roller as said metering roller rotates past said chamber containing said printing fluid, said means for substantially removing excess printing fluid attached to said means for housing and having at least an edge for substantially contacting said surface of said metering roller;

means for surface sealing attached to said means for housing opposed from said means for substantially removing excess printing fluid, said means for surface sealing having a surface area for substantially sealing said chamber, said surface area being substantially adjacent said surface of said metering roller and located intermediate first and second edges of said means for surface sealing, said means for surface sealing being a sealing member that seals statically and floats dynamically, said sealing member substantially floating and forming a hydrodynamic seal between said surface of said metering roller and said surface area of said sealing member when said metering roller rotates, and said sealing member substantially contacting said surface of said metering roller and said surface area of said sealing member when said metering roller is stationary, thereby sealing said chamber to keep said printing fluid in said chamber under pressure;

at least one inlet means in said means for housing for inputting said printing fluid into said chamber and at least one outlet means in said means for housing for outputting printing fluid from said chamber, said inlet means and said outlet means connected to a means for pressurizing said printing fluid.

2. The improved printing fluid input apparatus according to claim 1, wherein said means for substantially removing excess printing fluid is a reverse angle doctor blade and wherein said sealing member is a sealing blade that is substantially longer and more flexible than said reverse angle doctor blade.

3. The improved printing fluid input apparatus according to claim 1, wherein said means for housing is located relative to said metering roller surface at a position which is one of all angular positions about the axis of said metering roller.

4. The improved printing fluid input apparatus according to claim 1, wherein said means for substantially removing excess printing fluid is held against said surface of said metering roller at least partly by the pressurized printing fluid in said chamber.

5. The improved printing fluid input apparatus according to claim 1, wherein said means for pressurizing said printing fluid has at least a printing fluid reservoir located at a position independent of a position of said chamber in said means for housing.

6. The improved printing fluid input apparatus according to claim 1, wherein means is provided for pivoting said means for housing between at least a first operating position against said metering roller and at least a second servicing position away from said metering roller.

7. In a keyless lithographic printing press having blanket cylinder, plate cylinder with printing plate mounted thereon, form rollers, a set of two or more inking rollers, and a system for supplying dampening water to the printing plate, an improved printing fluid input system comprising:

metering roller having at least first and second ends mounted for rotation about an axis and having an oleophilic and hydrophobic surface intermediate said first and second ends, said surface capable of retaining a quantity of printing fluid;

housing having an open first side which mates with at least a portion of said surface of said metering roller to define a closed chamber containing said printing fluid under a predetermined pressure;

at least first and second end seal assemblies mounted on first and second opposed ends of said housing, each of said first and second end seal assemblies having at least a first surface for mating with first and second end sections, respectively, of said metering roller;

reverse angle doctor blade attached to a second side of said housing and having an edge for substantially contacting said surface of said metering roller and for substantially removing excess printing fluid adhering to said surface as said metering roller rotates past said chamber containing said printing fluid;

sealing member attached to a third side of said housing, said third side of said housing being opposed from said second side of said housing, said sealing member having a surface area for substantially sealing said chamber, said surface area of said sealing blade being substantially adjacent said surface of said metering roller and located intermediate first and second edges of said sealing member, said sealing member sealing statically and floating dynamically, said sealing member substantially floating and forming a hydrodynamic seal between said surface of said metering roller and said surface area of said sealing member when said metering roller rotates, and said sealing member substantially contacting said surface of said metering roller and forming a contact seal between said surface of said metering roller and said surface area of said sealing member when said metering roller is stationary, thereby sealing said chamber to keep said printing fluid in said chamber under pressure;

at least, said metering roller, said first and second end seal assemblies, said reverse angle doctor blade and said sealing member forming a means for substantially sealing said chamber such that said printing fluid is under said predetermined pressure;

at least one inlet means in said housing for inputting printing fluid into said chamber and at least one outlet means in said housing for outputting printing fluid from said chamber, said inlet means and said outlet means connected to a means for pressurizing said printing fluid.

8. The improved printing fluid input system according to claim 7, wherein said sealing member is substantially longer and more flexible than said reverse angle doctor blade.

9. The improved printing fluid input system according to claim 7, wherein said housing is located relative to said metering roller surface at a position which is one of all angular positions about the axis of said metering roller.

10. The improved printing fluid input system according to claim 7, wherein said open first side of said housing has a length substantially equal to an axial length of said surface of said metering roller.

11. The improved printing fluid input system according to claim 7, wherein said reverse angle doctor blade is held against said surface of said metering roller at least partly by the pressurized printing fluid in said chamber.

12. The improved printing fluid input system according to claim 7, wherein means for oscillating is connected to said metering roller, said housing being stationary when said metering roller is oscillated.

13. The improved printing fluid input system according to claim 7, wherein said means for pressurizing said printing fluid has means for controlling the rate of flow of said printing fluid through said chamber in said housing.

14. The improved printing fluid input system according to claim 7, wherein said means for pressurizing is a circulating system having a pump driven at a speed related to the speed of the printing press, said pump having an output connected to said inlet means of said housing and an input connected to a printing fluid reservoir, said inlet means of said housing also connected to said printing fluid reservoir.

15. The improved printing fluid input system according to claim 14, wherein said printing fluid reservoir is located at a position independent of a position of said chamber in said housing.

16. The improved printing fluid input system according to claim 7, wherein said means for pressurizing is a circulating system having a pump with an output connected to at least one regulating check valve in at least one bypass branch of the circulating system, said bypass branch also connected to a printing fluid reservoir in said system, said output of said pump also connected to said inlet means of said housing and said outlet means of said housing connected to an input of said pump via said printing fluid reservoir.

17. The improved printing fluid input system according to claim 16, wherein said printing fluid reservoir is located at a position independent of a position of said chamber in said housing.

18. The improved printing fluid input system according to claim 7, wherein each of said end seal assemblies has a seal cap attached to said housing, said seal cap containing a seal having a configuration which substantially conforms to its respective end section of said metering roller.

19. The improved printing fluid input system according to claim 18, wherein said seal is composed of a substantially pliable material such that said seal forms a substantially printing fluid tight seal for said housing by engaging a respective end of said reverse angle doctor blade, a respective end of said sealing member and a respective end section of said metering roller.

20. The improved printing fluid input system according to claim 7, wherein said metering roller further has at least one gage assembly located adjacent at least one of first and second end sections of said metering roller for engaging said housing and positioning said housing relative to said metering roller.

21. The improved printing fluid input system according to claim 7, wherein means is provided for pivoting said housing between at least a first operating position against said metering roller and at least a second servicing position away from said metering roller.

22. The improved printing fluid input system according to claim 7, wherein said sealing member is composed of a substantially flexible material and has said first edge attached to said housing and said second edge extending into said chamber, said surface area of said sealing member being intermediate said first and second edges and substantially adjacent said surface of said metering roller.

23. The improved printing fluid input system according to claim 7, wherein said sealing member is formed of plastic and has a width in the range of approximately 1 to 2 inches and a thickness in the range of approximately 0.004 to 0.01 inch.

24. The improved printing fluid input system according to claim 7, wherein said sealing member is formed of steel and has a width in the range of approximately 1 to 2 inches and a thickness in the range of 0.004 to 0.01 inch.

25. The improved printing fluid input system according to claim 7, wherein said reverse angle doctor blade is formed of steel and has a width of approximately 1 inch and a thickness in the range of approximately 0.004 to 0.01 inch.

26. The improved printing fluid input system according to claim 7 wherein said reverse angle doctor blade is formed of plastic and has a width of approximately 1 inch and a thickness in the range of approximately 0.04 to 0.06 inch.

27. In a keyless lithographic printing press having blanket cylinder, plate cylinder with printing plate mounted thereon, form rollers, a set of two or more inking rollers, and a system for supplying dampening water to the printing plate, an improved printing fluid input system comprising:

metering roller having at least first and second ends mounted for rotation about an axis and having an oleophilic and hydrophobic surface intermediate said first and second ends, said surface capable of retaining a quantity of printing fluid;

housing having an open first side which mates with at least a portion of said surface of said metering roller to define a closed chamber containing said printing fluid under a predetermined pressure, said housing located relative to said metering roller surface at a position which is one of all angular positions about the axis of said metering roller;

at least first and second end seal assemblies mounted on first and second opposed ends of said housing, each of said first and second end seal assemblies having at least a first surface for mating with at least first and second end sections, respectively, of said metering roller;

reverse angle doctor blade having a first edge attached to a second side of said housing and having a second edge for substantially contacting said surface of said metering roller and for removing excess printing fluid adhering to said surface as said metering roller rotates past said chamber containing said printing fluid, said reverse angle doctor blade being held against said surface of said metering roller at least partly by the pressurized printing fluid in said chamber;

sealing member attached to a third side of said housing, said third side of said housing being opposed from said second side of said housing, said sealing member having a surface area for substantially sealing said chamber, said surface area of said sealing member being substantially adjacent said surface of said metering roller, said sealing member being substantially longer and more flexible than said reverse angle doctor blade, and said sealing member having a first edge attached to said housing and a second edge extending into said chamber, said surface area of said sealing member being intermediate said first and second edges;

at least, said metering roller, said first and second end seal assemblies, said reverse angle doctor blade and said sealing member forming a means for substantially sealing said chamber such that said printing fluid is under said predetermined pressure;

at least one inlet means in said housing for inputting said printing fluid into said chamber, and at least one outlet means for outputting said printing fluid from said chamber, said inlet means and said outlet means connected to a means for pressurizing said printing fluid, said means for pressurizing having means for controlling the rate of flow of said printing fluid through said chamber in said housing and also having a printing fluid reservoir which is located at a position independent of a position of said chamber in said housing;

wherein said sealing member seals statically and floats dynamically, said sealing member substantially floating and forming a hydrodynamic seal between said surface of said metering roller and said surface area of said sealing member when said metering roller rotates, and said sealing member substantially contacting said surface of said metering roller and forming a contact seal between said surface of said metering roller and said surface area of said sealing member when said metering roller is stationary, thereby sealing said chamber to keep said printing fluid in said chamber under pressure.

28. The improved printing fluid input system according to claim 27, wherein said open first side of said housing has a length substantially equal to an axial length of said surface of said metering roller.

29. The improved printing fluid input system according to claim 27, wherein means for oscillating is connected to said metering roller, said housing being stationary when said metering roller is oscillated.

30. The improved printing fluid input system according to claim 27, wherein said means for pressurizing is a circulating system having a pump driven at a speed related to the speed of the printing press, said pump having an output connected to said inlet means of said housing and an input connected to said printing fluid reservoir, said outlet means of said housing also connected to said printing fluid reservoir.

31. The improved printing fluid input system according to claim 27, wherein said means for pressurizing is a circulating system having a pump with an output connected to at least one regulating check valve in at least one bypass branch of the circulating system, said bypass branch also connected to said printing fluid reservoir in said system, said output of said pump also connected to said inlet means of said housing and said outlet means of said housing connected to an inlet of said pump via said printing fluid reservoir.

32. The improved printing fluid input system according to claim 27, wherein each of said end seal assemblies has a seal cap attached to said housing containing a seal having a configuration which substantially conforms to its respective end section of said metering roller.

33. The improved printing fluid input system according to claim 32, wherein said seal is composed of a substantially pliable material such that said seal forms a substantially printing fluid tight seal for said housing by engaging a respective end of said reverse angle doctor blade, a respective end of said sealing blade and a respective end section of said metering roller.

34. The improved printing fluid input system according to claim 27, wherein said metering roller further has first and second gage assemblies located adjacent said first and second end sections, respectively, of said metering roller for engaging said housing and positioning said housing relative to said metering roller.

35. The improved printing fluid input system according to claim 27, wherein means is provided for pivoting said housing between at least a first operating position against said metering roller and at least a second servicing position away from said metering roller.

36. The improved printing fluid input system according to claim 27, wherein said sealing member is formed of plastic and has a width in the range of approximately 1 to 2 inches and a thickness in the range of approximately 0.004 to 0.01 inch.

37. The improved printing fluid input system according to claim 27, wherein said sealing member is formed of steel and has a width in the range of approximately 1 to 2 inches and a thickness in the range of approximately 0.004 to 0.01 inch.

38. The improved printing fluid input system according to claim 27, wherein said reverse angle doctor blade is formed of steel and has a width of approximately 1 inch and a thickness in the range of approximately 0.004 to 0.01 inch.

39. The improved printing fluid input system according to claim 27, wherein said reverse angle doctor blade is formed of plastic and has a width of approximately 1 inch and a thickness in the range of approximately 0.04 to 0.06 inch.

* * * * *